US008020498B2

(12) United States Patent
Cavaliere et al.

(10) Patent No.: US 8,020,498 B2
(45) **Date of Patent: *Sep. 20, 2011**

(54) METHODS AND APPARATUS FOR ENHANCED INCINERATION

(75) Inventors: William A. Cavaliere, Kamuela, HI (US); Berkeley F. Fuller, Kamuela, HI (US)

(73) Assignee: Phase Inc., Kamuela, HI (US)

( * ) Notice: Subject to any disclaimer, the term of this patent is extended or adjusted under 35 U.S.C. 154(b) by 518 days.

This patent is subject to a terminal disclaimer.

(21) Appl. No.: 12/113,629

(22) Filed: May 1, 2008

(65) Prior Publication Data

US 2008/0271654 A1 Nov. 6, 2008

Related U.S. Application Data

(60) Provisional application No. 60/927,366, filed on May 1, 2007, provisional application No. 60/927,386, filed on May 2, 2007, provisional application No. 60/928,476, filed on May 8, 2007.

(51) Int. Cl.

| | |
|---|---|
| ***F23J 3/00*** | (2006.01) |
| ***B04B 5/00*** | (2006.01) |
| ***B04B 1/04*** | (2006.01) |

(52) U.S. Cl. ..... 110/216; 494/32; 494/34; 494/68; 494/69; 494/80

(58) Field of Classification Search ..... 110/216, 110/245; 209/139.2, 13, 710, 711, 712; 494/32, 494/34, 68, 69, 56, 80, 70

See application file for complete search history.

(56) References Cited

U.S. PATENT DOCUMENTS

| | | | | |
|---|---|---|---|---|
| 899,312 | A | | 9/1908 | Manley |
| 2,199,849 | A | | 5/1940 | Bryson |
| 2,725,950 | A | | 12/1955 | Christiansen ..... 183/6 |
| 2,837,272 | A | | 6/1958 | Laguilharre |
| 3,104,225 | A | * | 9/1963 | Di Benedetto ..... 494/45 |
| 3,472,185 | A | * | 10/1969 | Burden, Jr. ..... 110/216 |
| 3,780,471 | A | | 12/1973 | Ort ..... 47/1.4 |
| 3,807,552 | A | * | 4/1974 | Gotthard ..... 209/11 |
| 3,861,584 | A | * | 1/1975 | Dudrey ..... 494/44 |
| 4,182,480 | A | | 1/1980 | Theyse ..... 233/27 |
| 4,364,905 | A | * | 12/1982 | Fahrig et al. ..... 422/144 |

(Continued)

FOREIGN PATENT DOCUMENTS

WO 2004/089549 10/2004

(Continued)

OTHER PUBLICATIONS

International Search Report and Written Opinion of International Application No. PCT/US2008/062224, 10 pages.

(Continued)

*Primary Examiner* — Kenneth Rinehart
*Assistant Examiner* — David J Laux
(74) *Attorney, Agent, or Firm* — Baker Botts L.L.P.

(57) ABSTRACT

The teachings of the present disclosure provide methods and apparatus for enhanced incineration. A method for improving the performance of an incinerator may comprise separating one or more substances from a process fluid using a classifying centrifuge, ejecting a first substance from the classifying centrifuge, the first substance having characteristics optimized for incineration, incinerating the first substance, and using heat generated from the incineration of the first substance to enhance the combustion efficiency of an additional substance separated from the process fluid.

3 Claims, 9 Drawing Sheets

U.S. PATENT DOCUMENTS

| | | | | |
|---|---|---|---|---|
| 4,608,040 | A * | 8/1986 | Knelson | 494/27 |
| 4,742,919 | A * | 5/1988 | Eriksson | 209/44.1 |
| 5,104,047 | A | 4/1992 | Simmons | 241/20 |
| 5,785,637 | A * | 7/1998 | Baptista et al. | 494/27 |
| 6,029,569 | A | 2/2000 | Packer | 99/537 |
| 6,067,943 | A * | 5/2000 | Morin et al. | 122/4 D |
| 6,398,706 | B1 * | 6/2002 | Huang | 494/48 |
| 7,434,694 | B1 * | 10/2008 | Elvin | 209/139.1 |
| 2004/0023782 | A1 | 2/2004 | Herman et al. | 494/49 |
| 2004/0142807 | A1 | 7/2004 | Cornay et al. | 494/33 |
| 2006/0053793 | A1 | 3/2006 | Schoell | 60/670 |
| 2008/0272067 | A1 * | 11/2008 | Cavaliere et al. | 210/788 |

FOREIGN PATENT DOCUMENTS

| | | |
|---|---|---|
| WO | 2008/137548 | 11/2008 |
| WO | 2008/137557 | 11/2008 |

OTHER PUBLICATIONS

International Search Report and Written Opinion of International Application No. PCT/US2008/062237, 9 pages.

International Preliminary Report on Patentability; Application No. PCT/US2008/062224, p. 9, Nov. 12, 2009.

International Preliminary Report on Patentability; Application No. PCT/US2008/062237, p. 8, Nov. 12, 2009.

* cited by examiner

METHODS AND APPARATUS FOR ENHANCED INCINERATION

RELATED APPLICATIONS

This application claims the benefit of U.S. provisional application No. 60/927,366 filed May 1, 2007; U.S. provisional application No. 60/927,386 filed May 2, 2007; and U.S. provisional patent application No. 60/928,476 filed May 8, 2007. The contents of these applications are incorporated herein in their entirety by this reference.

TECHNICAL FIELD

The present invention is related to the separation of substances from a process fluid, and more specifically to methods and apparatus for enhanced incineration.

BACKGROUND OF THE INVENTION

A centrifuge typically comprises a piece of equipment operable to put objects or a process fluid in rotation around a central longitudinal axis. Rotation applies centripetal force to the contents of the centrifuge. Over time, the heavier or denser substances contained therein will settle at the greatest distance from the longitudinal axis. A centrifuge may be used to separate one or more substances from a process fluid.

One useful process making use of a centrifuge is known as classifying. Classifying allows removal of one or more substances from a process fluid as well as separating the different substances from one another. Such classification may be used in a variety of processes (e.g., kaolin classification, cattle product rendering, many food processes, and/or metal recovery).

For example, used drilling mud returning from a well bore may include barite, hematite, or other additives, as well as solids debris from the drill bit or rock, plus water or other fluids used to transport those materials. While the solids debris is unlikely to be of further utility, the barite, hematite, and/or other additives may be used again if they can be separated from the drilling mud and the debris. In addition, the water and/or other transport fluid may be prepared for reuse or environmentally acceptable disposal by removal of one or more substances listed above.

Often, classifying is performed in two or more separate steps, using separate pieces of equipment. An improved classifying centrifuge may provide the same benefit but simplify and/or reduce the maintenance, operation, cost and/or energy consumption over known classifying centrifuges.

SUMMARY OF THE INVENTION

In accordance with teachings of the present disclosure, one embodiment may include a method for improving the performance of an incinerator. The method may include separating one or more substances from a process fluid using a classifying centrifuge, ejecting a first substance from the classifying centrifuge, incinerating the first substance, and using heat generated from the incineration of the first substance to enhance the combustion efficiency of an additional substance separated from the process fluid. The first substance may have characteristics optimized for incineration.

Another embodiment may include a system for removing substances from a process fluid. The system may comprise a centrifuge body rotatable around a longitudinal axis, an outlet extending from the centrifuge body, and an incinerator coupled with the outlet to receive substances removed from the process fluid by the centrifuge body. The centrifuge body may have a first end and a second end. The first end may be configured for receiving the process fluid. The second end may be configured for dispensing a clarified fluid.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The teachings of the present disclosure may demonstrate a classifying centrifuge, methods of use and/or methods of construction of a classifying centrifuge. Preferred embodiments of the invention and its advantages are best understood by reference to FIGS. 1-9 wherein like number refer to same and like parts.

As used throughout this disclosure, the term "fluid" may be used to include liquids, gases or a combination of liquids and gases with or without suspended solids or particulate matter.

"Process fluid" may generally be defined as a fluid stream containing liquids and/or gases along with suspended solids, colloidal and/or particulate matter including, but not limited to, nanoparticles (e.g., a slurry). Classifying centrifuges may be used to separate various components of a process fluid in accordance with teachings of the present disclosure.

"Clarified fluids" may include liquids and/or gases which remain after one or more substances have been removed from a process fluid. Any substances removed from a classifying centrifuge may be referred to as "ejecta" or "removed solids."

Figure 1:
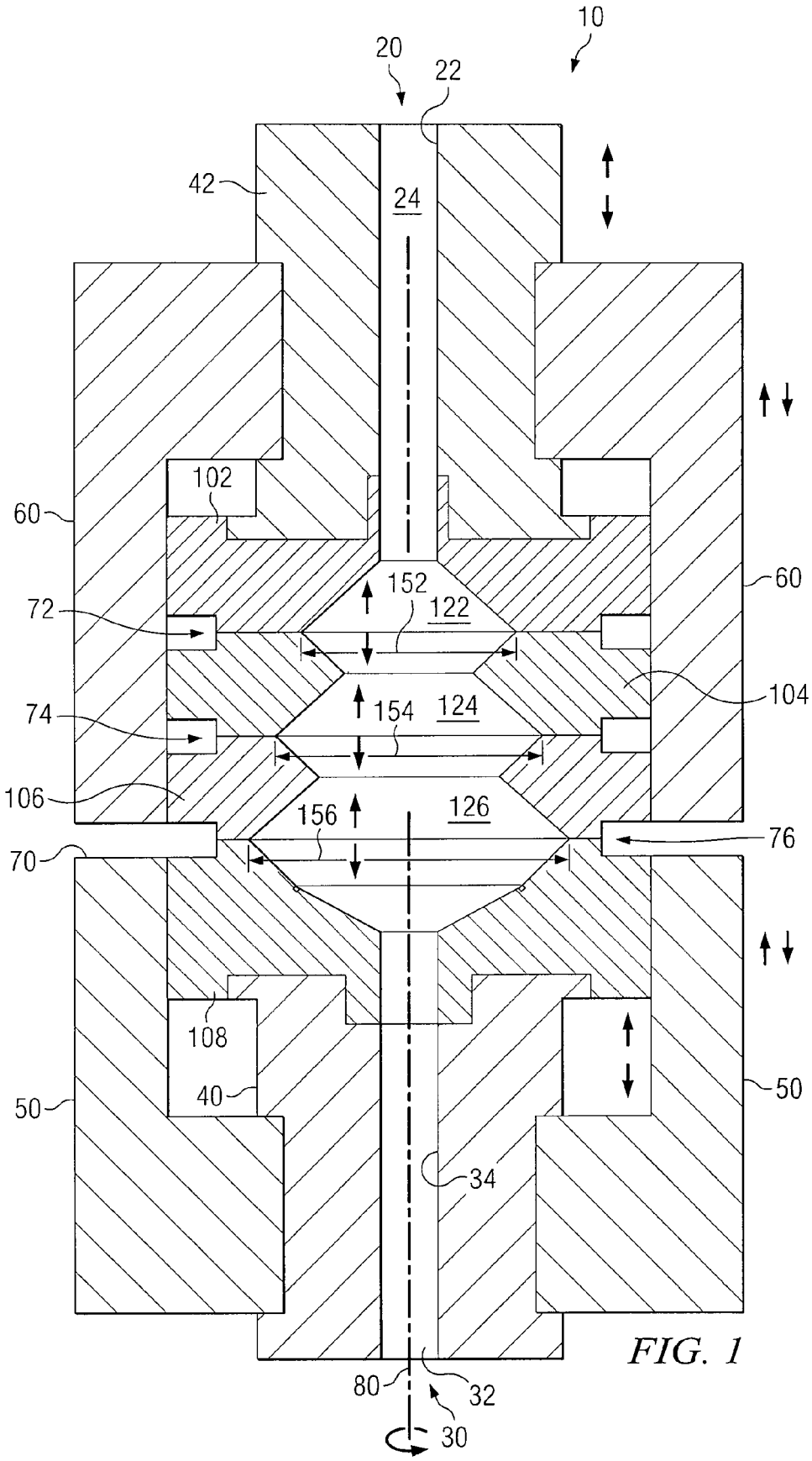
FIG. 1 depicts a cross-section view of a classifying centrifuge in accordance with teachings of the present disclosure.

FIG. 1 depicts a cross-section view of a classifying centrifuge 10 in accordance with teachings of the present disclosure. Classifying centrifuge 10 may include a first end 20, a second end 30, a rotational drive 40, a bottom shell 50, a top shell 60, one or more ejecta outlets 70, a longitudinal axis 80, one or more annular bodies (e.g., 102, 104, and 106), and one or more internal working spaces (e.g., 122, 124, and 126). Classifying centrifuge 10 may be any body mounted to rotate around longitudinal axis 80 and including appropriate working spaces therein.

First end 20 may include one end of classifying centrifuge 10 and may be configured for receiving a process fluid. First end 20 may include a process fluid inlet 22 associated with an inlet fluid path 24.

Process fluid inlet 22 may include any feature, device, and/or component configured to receive a process fluid. For example, process fluid inlet 22 may include an opening in first end 20, a tube, a valve, a fitting, a faucet, a tap, a spigot, a port, and/or other inlet. Process fluid inlet 22 may be associated with any feature, device, and/or component configured to deliver a process fluid from an external source. For example, process fluid inlet 22 may be associated with a process fluid line, a piping system, a funnel, and/or any other automatic or manual system for delivery of fluid.

Inlet fluid path 24 may include any feature, device, and/or component of classifying centrifuge 10 configured to provide a path from process fluid inlet 22 to one or more working spaces 120 within classifying centrifuge 10. For example, inlet fluid path 24 may include a straight pipe, flexible tubing, an opening bored through some part of the body of classifying centrifuge 10, and/or any other appropriate fluid path.

Second end 30 may include one end of classifying centrifuge 10 and may be configured for dispensing a clarified fluid. Second end 30 may include a clarified fluid outlet 32 associated with an outlet fluid path 34.

Clarified fluid outlet 32 may include any feature, device, and/or component configured to dispense a clarified fluid. For example, clarified fluid outlet 32 may include an opening in second end 30, a tube, a valve, a fitting, a faucet, a tap, a spigot, a port, and/or other inlet. Clarified fluid outlet 32 may be associated with any feature, device, and/or component configured to deliver a clarified fluid to an external receiver. For example, clarified fluid outlet 32 may be associated with a process fluid line, a piping system, a funnel, and/or any other automatic or manual system for receipt of fluid.

Outlet fluid path 34 may include any feature, device, and/or component of classifying centrifuge 10 configured to provide a path from one or more working spaces 120 within classifying centrifuge 10 to clarified fluid outlet 32. For example, outlet fluid path 34 may include a straight pipe, flexible tubing, an opening bored through some part of the body of classifying centrifuge 10, and/or any other appropriate fluid path.

Rotational drive 40 may include any device and/or system operable to rotate one or more portions of classifying centrifuge 10 around its longitudinal axis 80. For example, rotational drive 40 may include a DC motor, an AC motor, a torque motor, a pneumatic motor, a thermodynamic motor, a hydraulic motor, and/or any other system for converting potential energy to rotational energy and/or torque. Rotational drive 40 may also include any components, devices, and/or features used to deliver such motion, energy, and/or torque to the appropriate portions of classifying centrifuge 10 (e.g., bearings, gears, a transmission, levers, fasteners, a drive shaft, etc.).

In some embodiments, such as that shown in FIG. 1, classifying centrifuge 10 may include separate bottom shell 50 and top shell 60. In other embodiments, a single shell may provide a housing for one or more of the components making up classifying centrifuge 10. In embodiments including bottom shell 50 and top shell 60, bottom shell 50 and top shell 60 may include any component and/or feature of classifying centrifuge 10 configured to provide a frame and/or body for working spaces 120 and/or any components making up classifying centrifuge 10. For example, bottom shell 50 may include a housing mounted to rotational drive 40 and configured to house one or more annular bodies (e.g., 102, 104, and 106) used to define working spaces (e.g., 122, 124, 126) within classifying centrifuge 10. Top shell 60 may include a housing providing process fluid inlet 22 and/or inlet flow path 24 and configured to house one or more internal segments 100 used to make working spaces 120 within classifying centrifuge 10.

Ejecta outlet 70 may be any feature, device and/or component of classifying centrifuge 10 configured to provide a path or other outlet for any substances removed from the process fluid during classification. For example, classifying centrifuge 10 may include one or more ejecta outlets 70 associated with each working space 120 therein. Ejecta outlet 70 may include a space between bottom shell 50 and top shell 60 or may include openings, fittings, and/or other features in either bottom shell 50, top shell 60, or a unitary shell.

In embodiments such as that shown in FIG. 1, classifying centrifuge 10 may include one or more ejecta outlets 70 associated with each working space 120. For example, first ejecta outlet 72 may be associated with first working space 122, second ejecta outlet 74 may be associated with second working space 124, and third ejecta outlet 76 may be associated with third working space 126. One or more of these outlets may feed ejecta to ejecta outlet 70 configured to deliver ejecta to the outside of classifying centrifuge 10. Each ejecta outlet 72, 74, and/or 76 may include any devices, components, and/or features of classifying centrifuge 10 and/or associated working spaces 120 configured to selectively release accumulated substances, solids, and/or other materials collected during the operation of classifying centrifuge 10. Some embodiments of outlets are discussed with greater detail in relation to FIGS. 3A-C.

Longitudinal axis 80 may be any axis around which the various components of classifying centrifuge 10 may rotate (e.g., axis of rotation). Persons having ordinary skill in the art will recognize that the placement of longitudinal axis 80 may be important to the maximum rotational speed and, therefore, efficiency at which classifying centrifuge 10 may be operated.

FIG. 1 depicts one embodiment of classifying centrifuge 10 including annular bodies 100 to define working spaces 120. Other embodiments may include bottom shell 50, top shell 60, and/or other shell components which define working spaces 120 without additional components. In one embodiment, bottom shell 50 and top shell 60 may be cylindrical sections having different external and internal diameters. In similar embodiments, classifying centrifuge 10 may include three or more cylindrical sections with increasing internal working spaces 120 and increasing external diameters, resulting in a stepped cylindrical shape for classifying centrifuge 10. In another embodiment, classifying centrifuge 10 may include a cylindrical barrel with a generally constant external diameter and increasing internal working spaces 120 along its length.

As shown in FIG. 1, annular body 102 may define the top half of internal working space 122. Annular body 104 may define the bottom half of internal working space 122 and the top half of internal working space 124. Annular body 106 may define the bottom half of internal working space 124 and the top half of internal working space 126. Annular body 108 may define the bottom half of internal working space 126. This particular method of construction for classifying centrifuge 10 may be extended to define any number of internal working spaces 120.

In general, classifying centrifuge 10 defines multiple internal working spaces 120 (e.g., 122, 124, and 126). Each internal working space may include a characteristic working diameter 150 (discussed in more detail in relation to FIG. 3A). Because each section of classifying centrifuge 10 rotates at the same angular speed, variation in working diameter 150 between internal working spaces 120 may provide variation in linear speed at the widest point of each internal working space 120. For example, as shown in FIG. 1, material at the widest point of internal working space 124 will rotate at a higher linear speed than material contained in internal working space 122. Higher linear speed may exert higher centripetal force against the material.

For that reason, classifying centrifuge 10 subjects the process fluid and any solids and/or other substances contained therein to two or more different levels of centripetal force based on the variation between the working diameters 150 of each internal working space 120. In some embodiments such as that shown in FIG. 1, a process fluid will travel from inlet flow path 24 to the first working space 122. The process fluid will flow from first working space 122 into successively larger working spaces (124, 126, etc.). In such embodiments, heavy weight ejecta may accumulate in internal working space 122 while progressively lighter ejecta may accumulate in larger internal working spaces (e.g., 124, and/or 126).

A system for the separation of suspended material from a process fluid may use varying internal working spaces 120 to take advantage of the fact that materials with high density may be removed with little force. In some cases, suspended materials with high density are easily separated by rotation. High density materials may separate from a working fluid at low rotational speed and/or at a short distance from the center of rotation. The suspended materials similar in density to the process fluid may require increased rotational speed or relatively greater distance from the center of rotation for separation. Successive removal of suspended solids and/or materials may allow the classification of several different materials from a process fluid stream.

Figure 2:
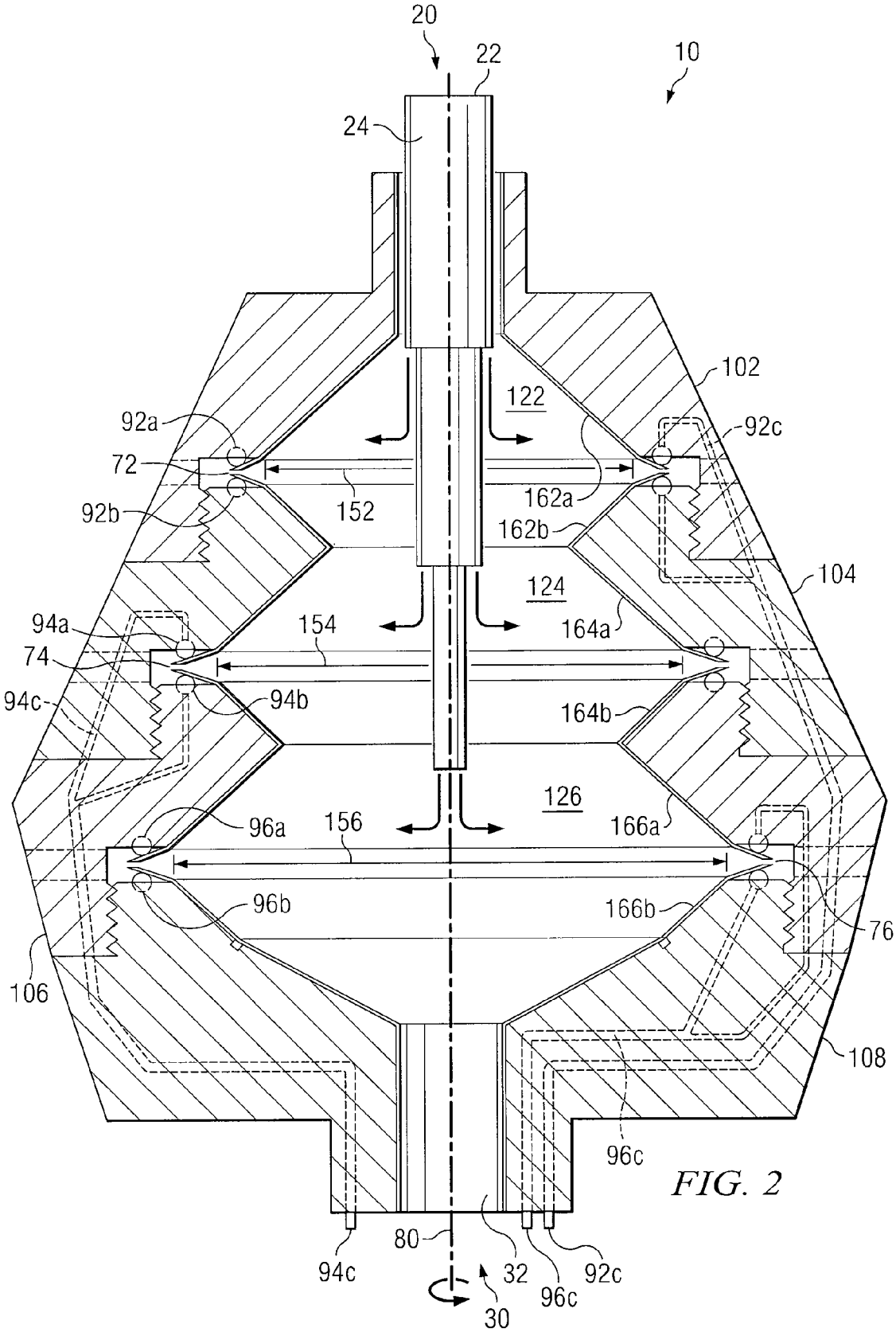
FIG. 2 depicts a cross-section view of a classifying centrifuge in accordance with teachings of the present disclosure.

FIG. 2 depicts a cross-section view of classifying centrifuge 10 in accordance with teachings of the present disclosure. As with the embodiment described in FIG. 1, classifying centrifuge 10 may include a first end 20, a second end 30, a rotational drive 40, one or more ejecta outlets 70, a longitudinal axis 80, one or more annular bodies 100, and one or more internal working spaces 120 with associated working diameters 150. Classifying centrifuge may be mounted in any appropriate manner to rotate around longitudinal axis 80.

In embodiments such as that shown in FIG. 2, classifying centrifuge 10 may also include one or more valve systems 90 associated with the one or more internal working spaces 120 and any ejecta outlet 70 (e.g., valve system 92 associated with internal working space 122 and ejecta outlet 72). Valve system 90 may include any devices, components, and/or features of classifying centrifuge 10 configured to control the flow of solids, ejecta, and/or any other substance through ejecta outlet 70. For example, valve system 90 may include systems designed to provide individual valving for each ejecta outlet 70, synchronized valving for each internal working space 120, and/or any other combination of valves and controls. One embodiment of valve system 90 is discussed in more detail in relation to FIGS. 3A-C.

FIG. 2 depicts an embodiment of classifying centrifuge 10 which does not require any external shells but may have an exterior and one or more internal working spaces defined by annular bodies 100. In the example shown in FIG. 2, classifying centrifuge 10 may be formed by assembling annular bodies 102, 104, 106, and 108 in sequence. One assembly method is discussed in relation to FIG. 5. As shown in FIG. 2, annular body 102 may define the top half of internal working space 122. Annular body 104 may define the bottom half of internal working space 122 and the top half of internal working space 124. Annular body 106 may define the bottom half of internal working space 124 and the top half of internal working space 126. Annular body 108 may define the bottom half of internal working space 128. Internal working spaces 100 may be arrayed along longitudinal axis 80 so that the entering process fluid may travel from the smallest to the largest internal working diameter 150. The exterior of classifying centrifuge 10 may be any shape and/or include any features configured to optimize the performance or efficiency of classifying centrifuge 10. As described in relation to FIG. 1, the example embodiment shown in FIG. 2 may separate multiple materials and/or substances from a stream of process fluid using successively larger internal working spaces.

Figure 3A:
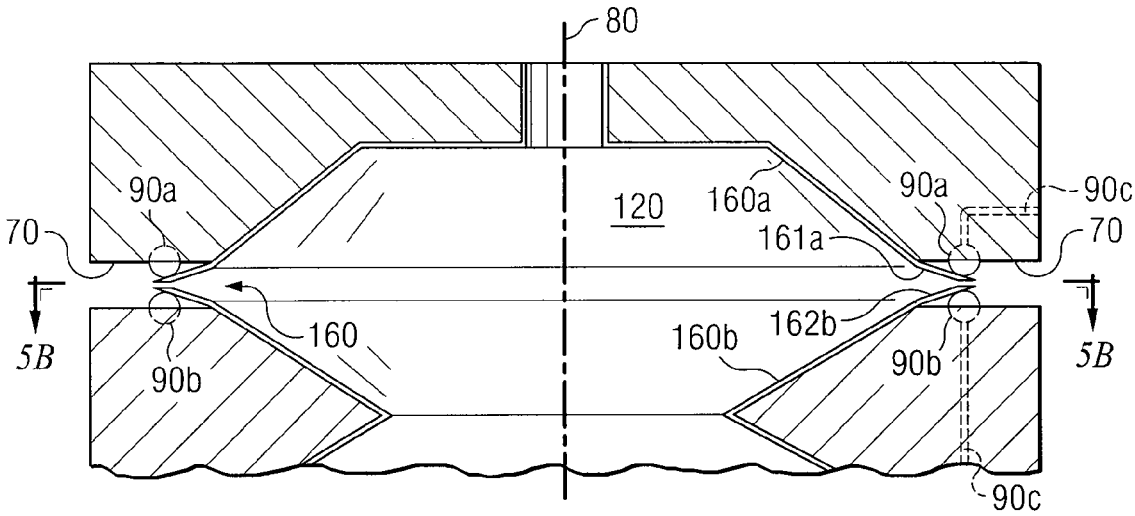
FIG. 3A depicts a cross-section view of an embodiment of an internal working space of a classifying centrifuge in accordance with teachings of the present disclosure.

FIG. 3A depicts a cross-section view of an embodiment of internal working space 120 of classifying centrifuge 10 in accordance with teachings of the present disclosure. In embodiments such as that shown in FIG. 3, ejecta outlet 70 may comprise an annular groove arrayed at the widest point of internal working space 120 and perpendicular to longitudinal axis 80. In some embodiments such as that shown in FIG. 3A, ejecta outlet 70 may be located at the greatest extent of working diameter 150. Solids, ejecta, and/or other substances forced into annular groove 70 by centripetal force resulting from the rotation of classifying centrifuge 10 may also undergo mechanical compression by passing through the v-shape formed by the narrowing walls of the internal working space 120. Additional compaction may result in de-watering and/or other clarifying processes. In other embodiments, the size and shape of annular groove 70 may be designed and/or configured to allow large particles to exit through ejecta outlet 70.

In embodiments of ejecta outlet 70 including an annular groove, the configuration of the annular groove may be designed for specific applications. For example, if the working fluid contains a high percentage of one solid material to be ejected, the ejecta outlet 70 for that material may include a relatively wide annular groove configured to allow a large amount of material to collect. In that example, ejecta outlet 70 for other materials may be relatively small. An annular groove may offer reduced hydrodynamic resistance in comparison to known ejecta outlets.

FIG. 3A also depicts a valve control system 90 that may be used in accordance with teachings of the present disclosure. Valve control system 90 may include bladders 90*a* and 90*b*, a conduit 90*c*, and one or more lips 161 of liners 160. In other embodiments, valve control system 90 may include any components or features of classifying centrifuge 10 configured to selectively allow ejecta to travel from internal working space 120 to ejecta outlet 70.

Figure 3B:
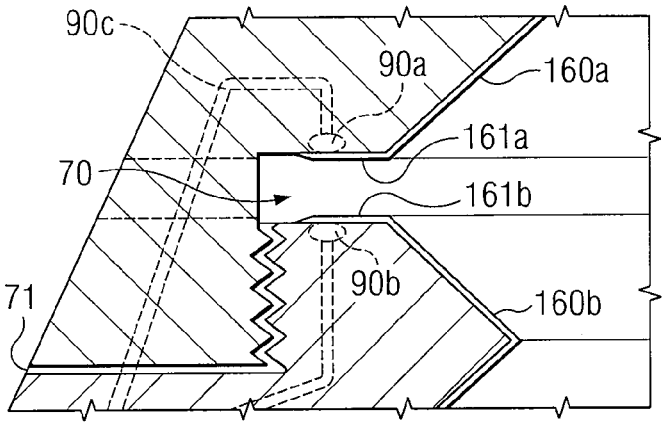
FIGS. 3B and 3C depict a close-up of the cross-section view shown in FIG. 3A.
Figure 3C:
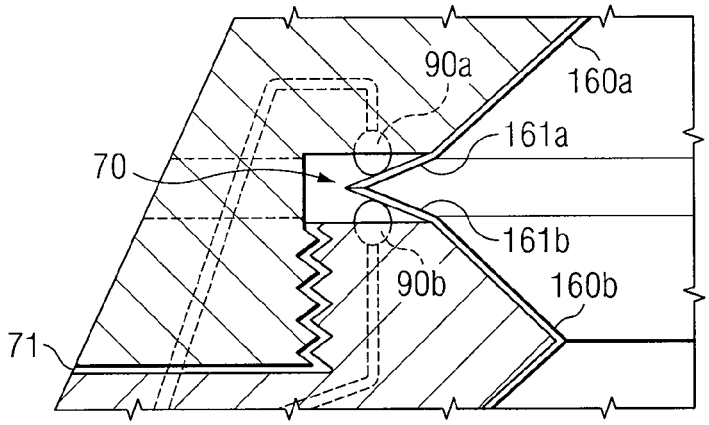

Bladders 90*a* and 90*b* may include any inflatable device or component configured to expand in conjunction with an increase in pressure. As shown in FIG. 3C, expanded bladders 90*a* and 90*b* may exert force against lips 161*a* and 161*b* and that force may resist the separation of lips 161*a* and 161*b*. In some embodiments, bladders 90*a* and 90*b* may include annular bladders that extend around the perimeter of internal working space 120.

Conduit 90*c* may include any feature or component of classifying centrifuge 10 configured to deliver fluid to bladders 90*a* and 90*b*. For example, conduit 90*c* may include a tube, a channel, or any other feature within the annular bodies (e.g., 102, 104, and/or 106) included in classifying centrifuge 10. In some embodiments, conduit 90*c* may be configured to deliver air, water, and/or oil as a working fluid.

Liners 160 may include any component of classifying centrifuge 10 configured to mate with the walls of internal working space 120. For example, liner 160 may include a replaceable sheet of material formed to the shape of internal working space 120. Liner 160 may deflect and/or absorb the impact of working fluids, solids, and/or other material. In some embodiments, liner 160 may include a sheet of material (e.g., urethane) configured to absorb and force and/or abrasion resulting from the impact of materials on the walls of internal working space 120.

Liners 160 may include lips 161. Lips 161 may include a flange and/or extension of liner 160 configured to protrude beyond the walls of internal working space 120. For example, as shown in FIGS. 3A-C, lips 161 may protrude into ejecta outlet 70. In the embodiment shown in FIGS. 3A-C, lips 161 may include flexible extensions of liner 160, configured to flex between an open position as shown in FIG. 3B and a closed position as shown in FIG. 3C.

In some embodiments, lips 161 may tend to rest in the closed position shown in FIG. 3A when no external forces are acting on lips 161. Lips 161 may be pinched closed by inflation of bladders 90*a* and 90*b*, movement of a mechanical body against lips 161, and/or any other means of mechanically deforming liner 160 on either end of ejecta outlet 70.

FIGS. 3B and 3C depict a cross-section view of a valve control system that may used in accordance with teachings of the present disclosure. In some embodiments, each ejecta outlet 70 may be associated with an unique valve system 90. As shown in FIGS. 3A-C, ejecta outlet 70 may be associated with a flow path 71 in fluid communication with ejecta outlet 70 and the exterior of classifying centrifuge 10. Selective operation of valve system 90 may allow the selective dispensing of ejecta from internal working space 120.

The valve system 90 depicted in FIGS. 3A-C may be disposed in ejecta outlet 70 (e.g., an annular groove). Valve system 90 may include lips 161*a* and 161*b* of respective liners 160*a* and 160*b*, as well as inflatable bladders 90*a* and 90*b*. As shown in FIG. 3B, valve system 90 may open as a result of centripetal force exerted by the rotation of classifying centrifuge 10. As shown in FIG. 3C, valve system 90 may be pinched closed by inflation of bladders 90*a* and 90*b*. Lips 161*a* and 161*b* may be held in a closed position by the expansion of bladders 90*a* and 90*b* even against the centripetal force generated by the rotation of classifying centrifuge 10.

Valve system 90 as shown in relation to FIGS. 3A-C may provide improved performance in comparison to valve systems known in the art. For example, valve system 90 may include components which are low in mass in comparison to known valve systems. If valve system 90 rotates with the main body of classifying centrifuge 10, a reduction in mass may provide reduced energy and/or power requirements for operation. In addition, valve system 90 may open and/or close more quickly than valve systems known in the art. Quick operation of valve system 90 may provide precise control over the release of accumulated solids and may, therefore, prevent the accidental ejection of wet material.

When the teachings of the present disclosure are combined to provide the control of valve system 90 and the benefit of ejecta outlet 70 including one or more annular grooves, classifying centrifuge 10 may provide one or more of the following benefits: control of the accumulation of solids within the annular groove; control of the length of time any collected solids reside within the annular groove; and the ability to quickly eject accumulated solids from internal working space 120 to ejecta outlet 70. These benefits may provide precise control over the amount and/or extent of de-watering of any accumulated solids.

Figure 4A:
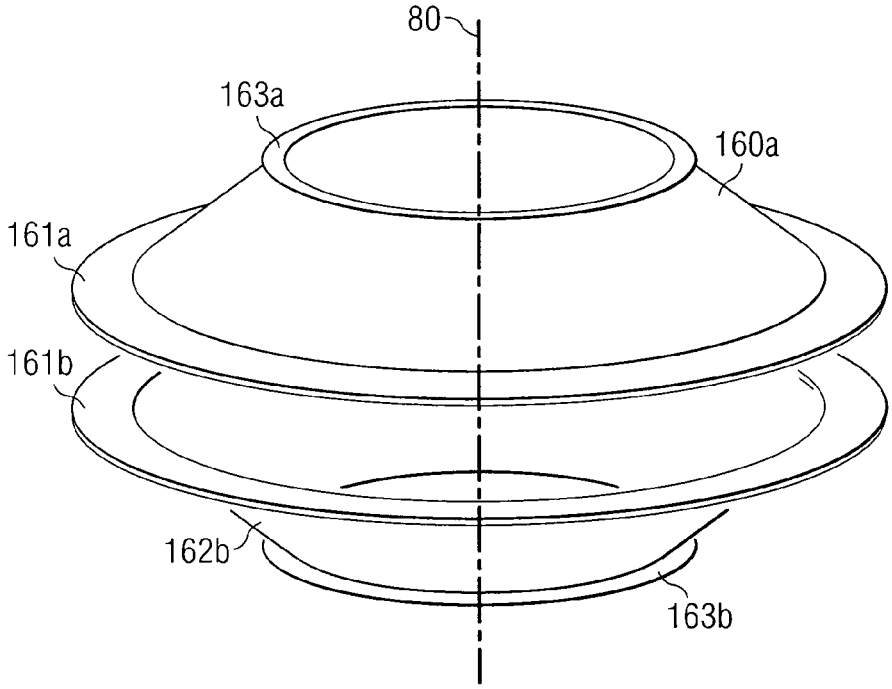
FIG. 4A depicts an isometric view of an embodiment of a component of a classifying centrifuge in accordance with teachings of the present disclosure.

FIG. 4A depicts an isometric view of liners 160*a* and 160*b* for use with a classifying centrifuge in accordance with teachings of the present disclosure. As discussed in relation to FIGS. 3A-C, liner 160 may include sheets of material configured to mate with one or more interior surfaces of internal working space 120. In the embodiment shown in FIGS. 4A and 4B, liner 160 may include a sheet of material generally in the shape of a truncated cone. Liner 160 may provide wear resistance to the one or more interior surfaces of internal working space 120.

Liner 160*a* may include integral lip 161*a* and/or flange configured to operate as a valve member in conjunction with an opposed lip 161*b* or flange of liner 160*b*. Liner 160 may include a ring 163. Ring 163 may include any feature or component of liner 160 configured to extend from the main body of liner 160. In the embodiment shown in FIGS. 4A and 4B, ring 163 may be disposed away from lip 161 at the narrowest diameter of liner 160.

Figure 4B:
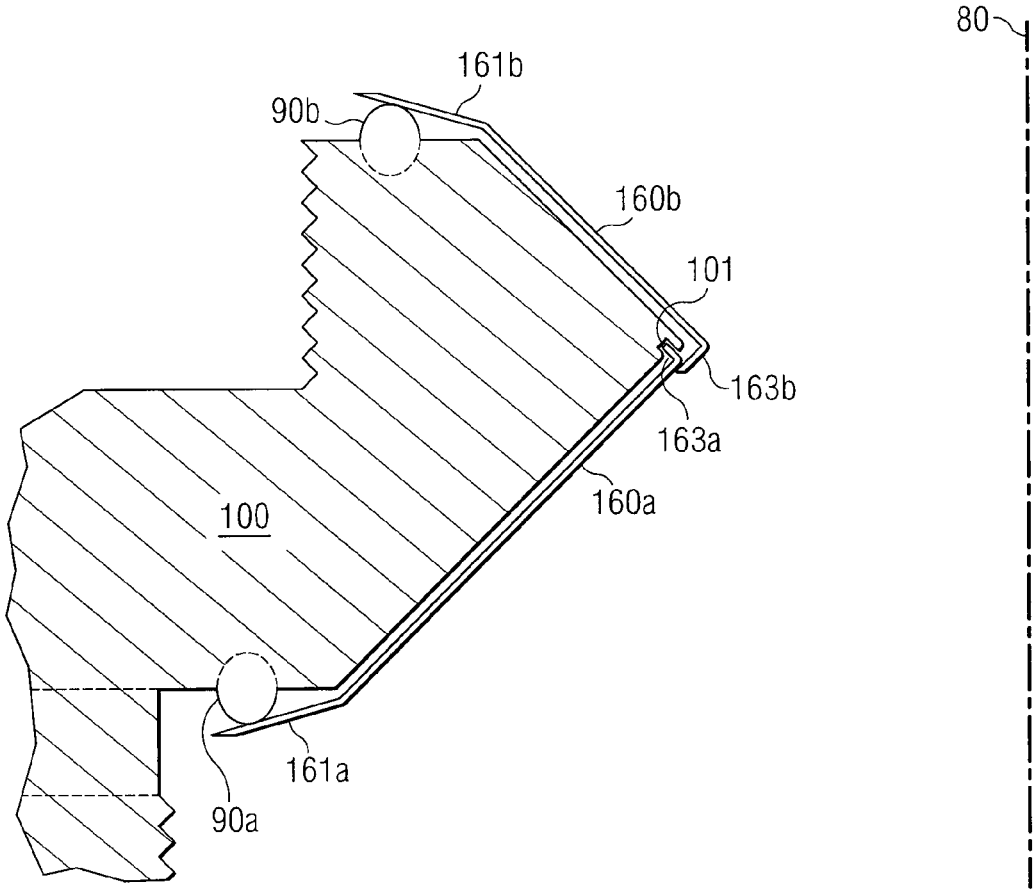
FIG. 4B depicts a cross-section view of part of an internal working space of a classifying centrifuge in accordance with teachings of the present disclosure.

FIG. 4B depicts a cross-section view of part of an internal working space of a classifying centrifuge in accordance with teachings of the present disclosure. As shown in FIG. 4B, classifying centrifuge 10 may include liners 160*a* and 160*b*. As discussed in relation to FIGS. 3A-C, liners 160*a* and 160*b* may be configured to work in conjunction with other components as a valve control system. FIG. 4B depicts one example of the mating between separate liners 160*a* and 160*b*. In other embodiments, liners 160*a* and 160*b* may be a single sheet of material formed to the shape of annular body 100.

Liners 160 may include one or more rings 163. For example, liner 160*a* may include ring 163*a* and liner 160*b* may include ring 163*b*. Ring 163 may include a flexible extension of liner 160 with enough rigidity to return to its original shape when any deforming force is removed.

Rings 163 may allow selective assembly or replacement of liners 160. For example, ring 163*a* may be configured to mate with a slot or groove 101 disposed in annular body 100. Ring 163*b* may be configured to overlap some portion of liner 160*a*. In this embodiment, rings 163*a* and 163*b* may cooperate to join liners 160*a* and 160*b* without exposing the surface of internal working space 120 to the working fluid of classifying centrifuge 10.

Figure 5:
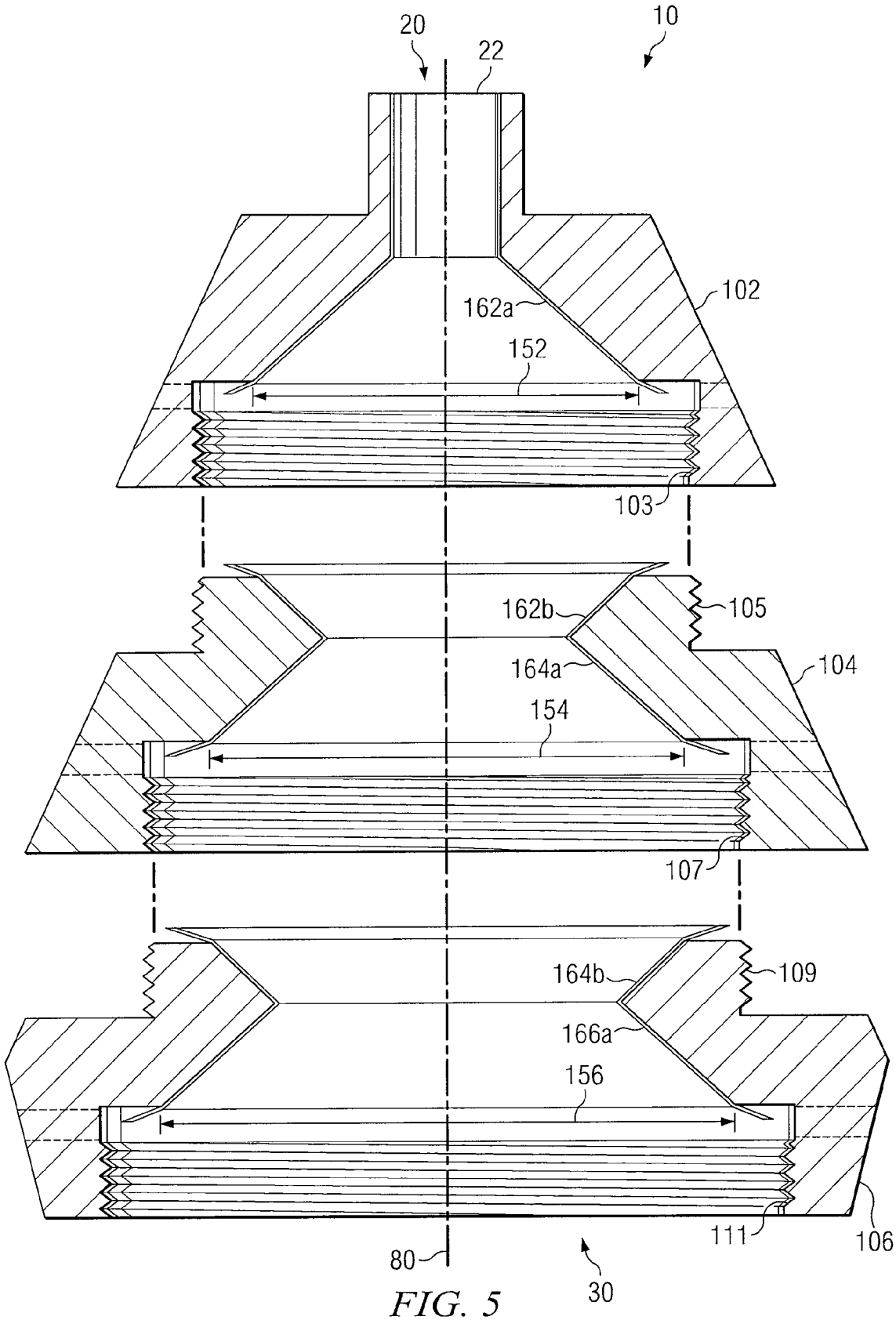
FIG. 5 depicts a cross-section view of multiple components which may be used to form a classifying centrifuge in accordance with teachings of the present disclosure.
Figure 9:
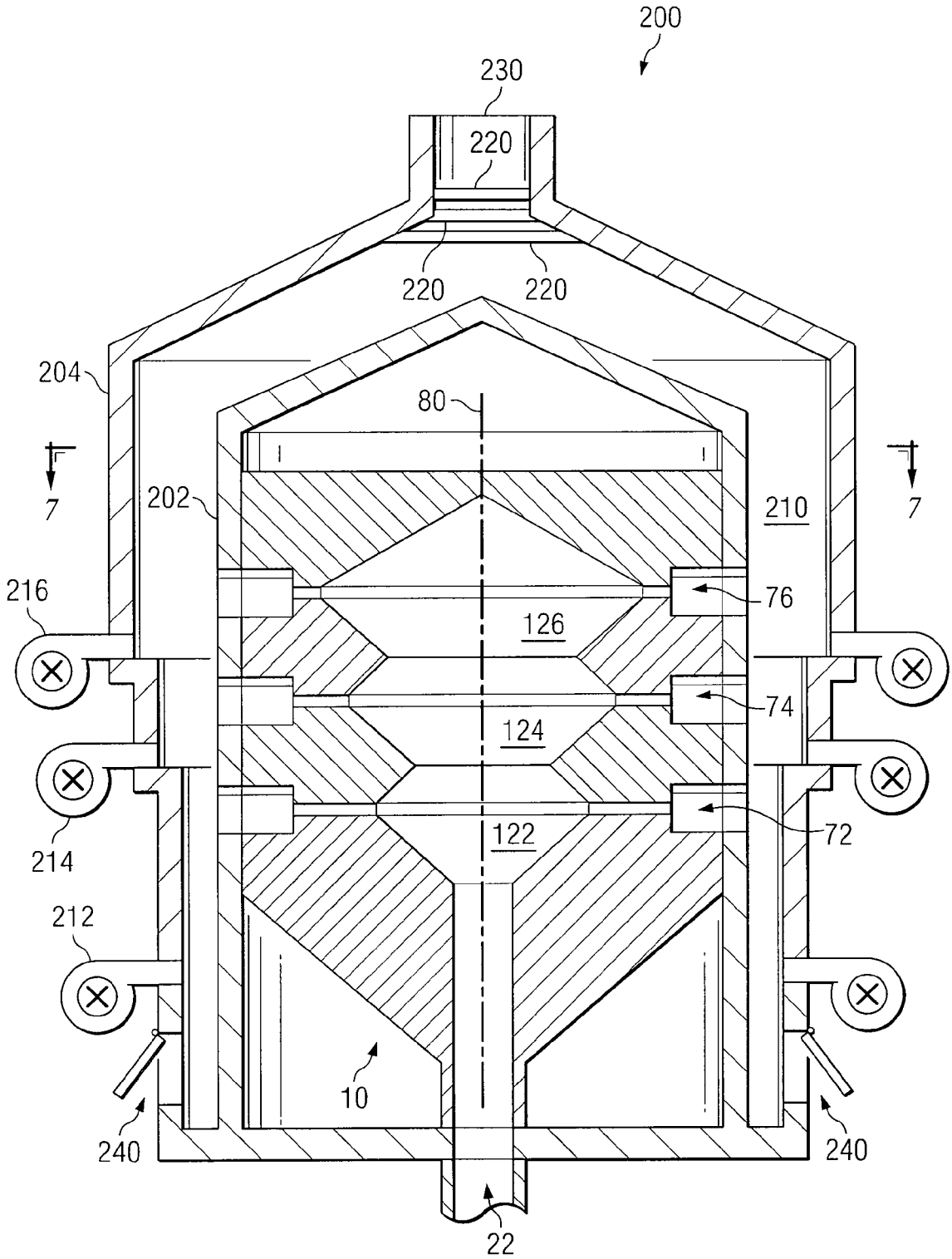
FIG. 9 depicts a cross-section view of an incinerator in accordance with teachings of the present disclosure.

FIG. 5 depicts a cross-section view of multiple annular bodies 100 which may be used to form a portion of classifying centrifuge 10 in accordance with teachings of the present disclosure. As shown in FIG. 2, one embodiment of classifying centrifuge 10 may include annular bodies 102, 104, and 106. Each annular body 100 may, when assembled, define a portion of one or more internal working spaces 120. As shown in FIG. 9, each annular body 100 may be formed with threads operable to connect with the other annular bodies 100. For example, annular body 102 may include internal threads 103 operable to connect with external threads 105 disposed on annular body 104, thus forming an internal working space 120 with a working diameter 152. Use of the assembly method shown in FIG. 9 may result in a series of internal working spaces 120 with increasing working diameters (e.g., 152, 154, 156, etc.).

Removable connections between annular bodies 100 may allow insertion or replacement of liners 160 as discussed with relation to FIGS. 4A and 4B. In addition, removable connections between annular bodies 100 may allow in the insertion of additional components or devices. For example, the insertion of the stacked cones 110 shown in FIG. 6 may improve performance of classifying centrifuge 10. The tightly packed stacked cone arrays cannot be inserted into a monolithic centrifuge body of the same shape without significant deformation to fit through clarified fluid outlet 32 or another passage to the internal working spaces 120.

Figure 6:
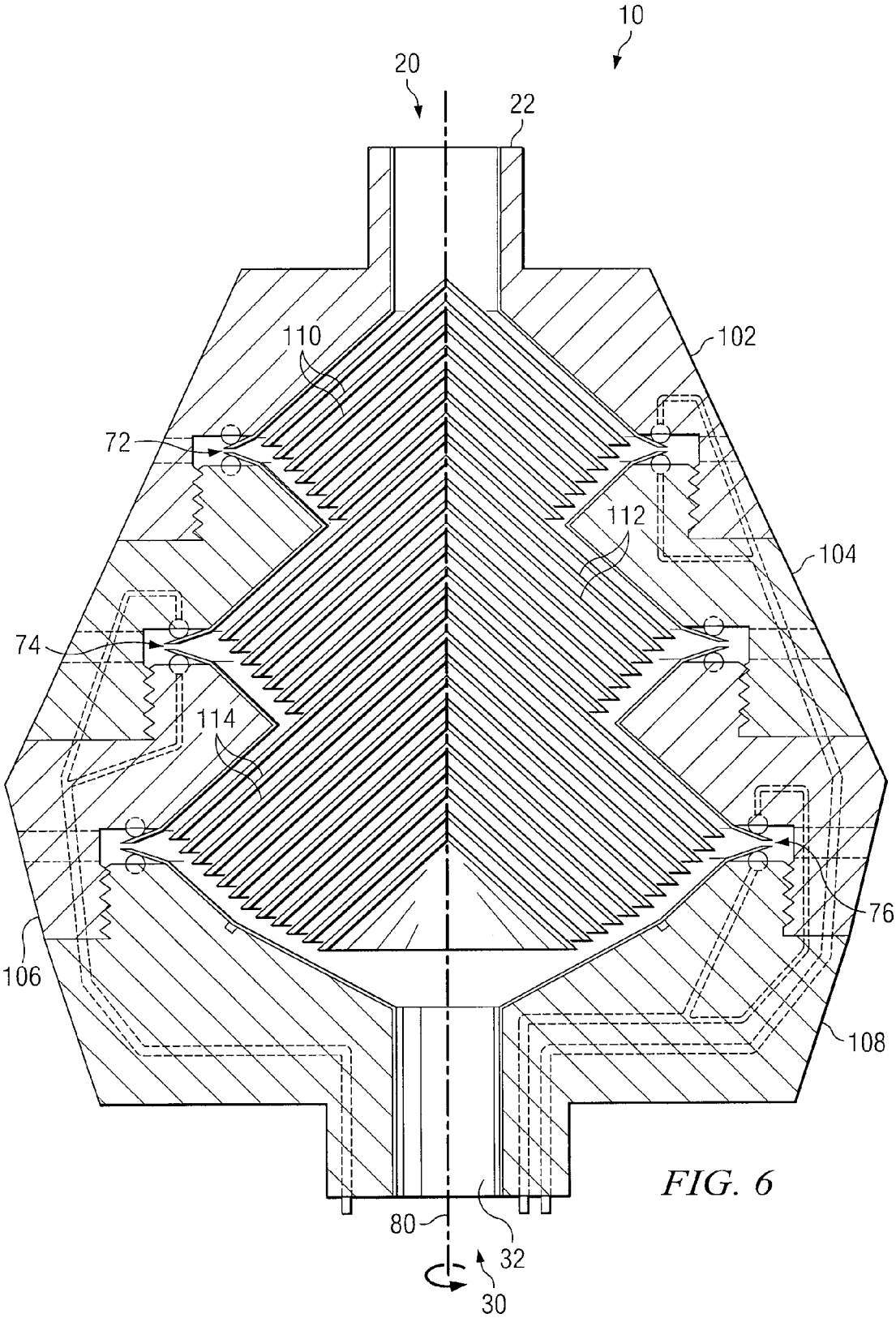
FIG. 6 depicts a cross-section view of one embodiment of a classifying centrifuge in accordance with teachings of the present disclosure.

FIG. 6 depicts a cross-section view of one embodiment of classifying centrifuge 10 in accordance with teachings of the present disclosure. As shown in FIG. 6, classifying centrifuge may include multiple cone-like members known as stacked cones 110, 112, and 114. It is known in the art that stacked cone arrays may be used in association with centrifuges to amplify or accelerate the separation of solids or other ejecta from a process fluid. In some applications, solids or other ejecta travel along the surface of the cones toward the outer diameter while lighter fluids travel along the longitudinal axis in the spaces between the cones.

FIG. 6 shows the classifying centrifuge of FIG. 2 along with a suitable array of stacked cones 110, 112, and/or 114. Each array may be configured to result in a tightly packed, or nesting array of cones. The surfaces of stacked cones 110, 112, and 114 may be shaped to channel solids and/or other ejecta toward the widest portion of the respective internal working spaces 120. The openings at the center of each cone 110, 112, and 114 may allow the lightest liquids to travel through the center of classifying centrifuge 10. The presence of stacked cones 110, 112, and/or 114 may provide increased residence time for process fluids and/or increased overall efficiency of separation.

In embodiments including arrays of stacked cones such as 110, 112, and/or 114, the present disclosure allows stacked cones which closely follow the shapes of internal working spaces 120. FIG. 5 demonstrates methods of construction that may facilitate installation of stacked cones 110, 112, and/or 114. The present disclosure may allow the use of stacked cones to affect the operating efficiency of classifying centrifuge 10.

Figure 7:
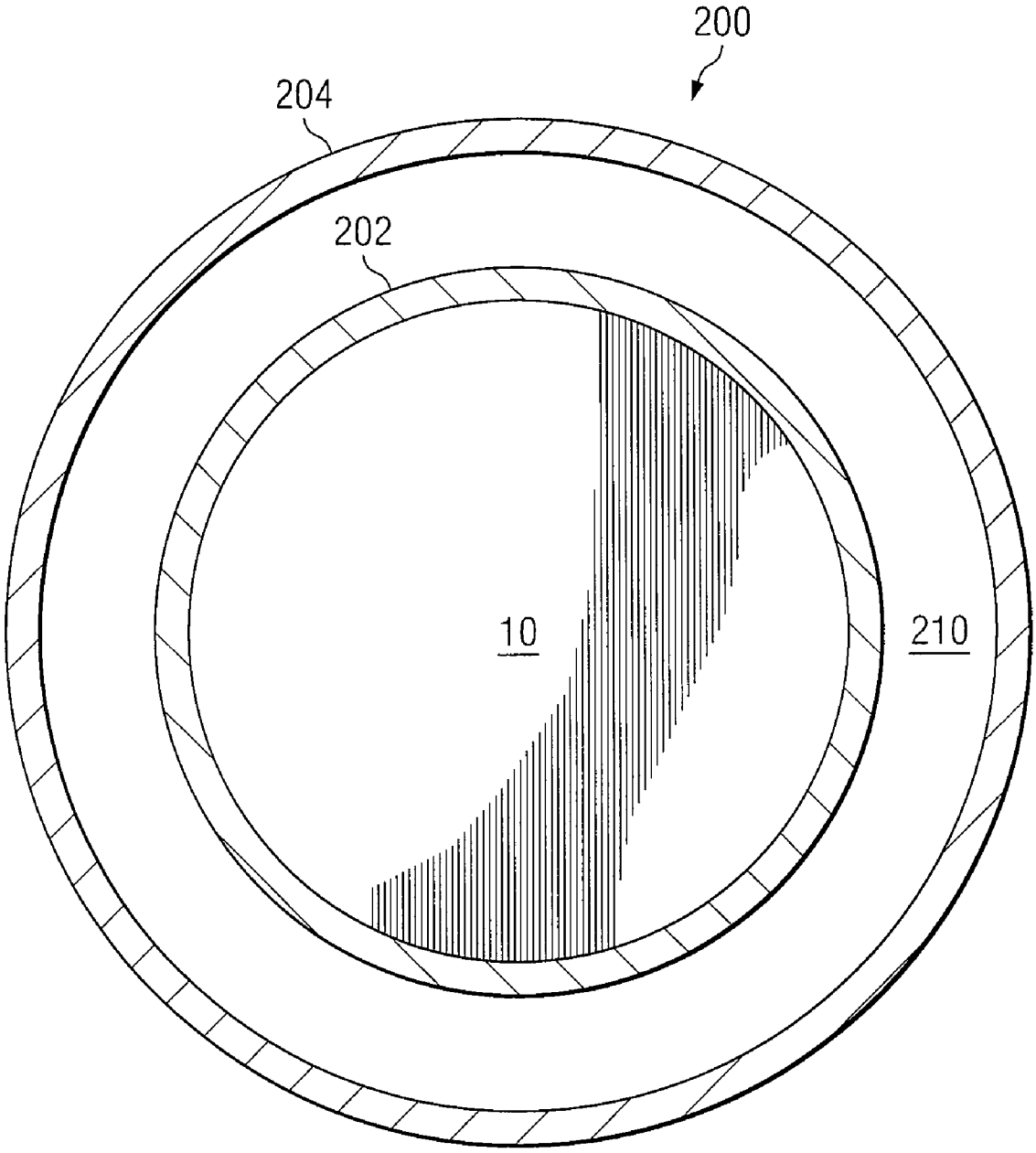
FIG. 7 depicts a top view of an incinerator in accordance with teachings of the present disclosure.

FIG. 7 depicts a top view of an incinerator system. Use of classifying centrifuge 10 in accordance in accordance with teachings of the present disclosure may produce separated materials, or ejecta, subject to rotary spin, centripetal force, and/or high pressure. Ejecta outlet 70 may be configured to atomize ejecta under high pressure, similar to the action of a fuel injector in an internal combustion engine. Because classifying centrifuge 10 may provide separated substances through different ejecta outlets 70, such ejecta may be selectively delivered to an incinerator or another system coupled with one or more ejecta outlets 70. Immediate combustion of ejecta may take advantage of the energy used in the separation process when compared to processes which allow the ejecta to settle, phase change, and/or chemically react prior to incineration.

For example, as shown in FIG. 7, classifying centrifuge 10 may be disposed within the body of an incinerator 200. Incinerator 200 may include an inner wall 202, an outer wall 204, and a combustion zone 210. Operation of classifying centrifuge 10 may deliver ejecta through inner wall 202 into combustion zone 210. Although FIG. 7 depicts classifying centrifuge disposed within incinerator 200, persons having ordinary skill in the art will recognize that a wide variety of orientations may be used to take advantage of the teachings of the present disclosure.

Because classifying centrifuge 10 may selectively deliver ejecta to combustion zone 210, the operation of incinerator 200 may be controlled by selecting the order and amounts of material to be incinerated. For example, if a first component of a process fluid is easier to combust than a second component, the first component may be delivered to combustion zone 210 independently. After the first component is incinerated, the second component may be delivered to combustion zone 210. The heat of combustion resulting from combustion of the first substance may result in the more rapid, thorough, complete, and/or efficient combustion of the second component.

For example, treatment of wastewater may include extensive treatment to separate contaminants or other materials and substances from the water. To efficiently combust most such materials, they must be de-watered to reach 45-50% solids content. Incinerator 200 operated in accordance with the teachings of the present disclosure may effectively incinerate those materials and facilitate recovery of wastewater. In other applications, de-watering of material may reduce the need to add fuel to initiate combustion.

Figure 8:
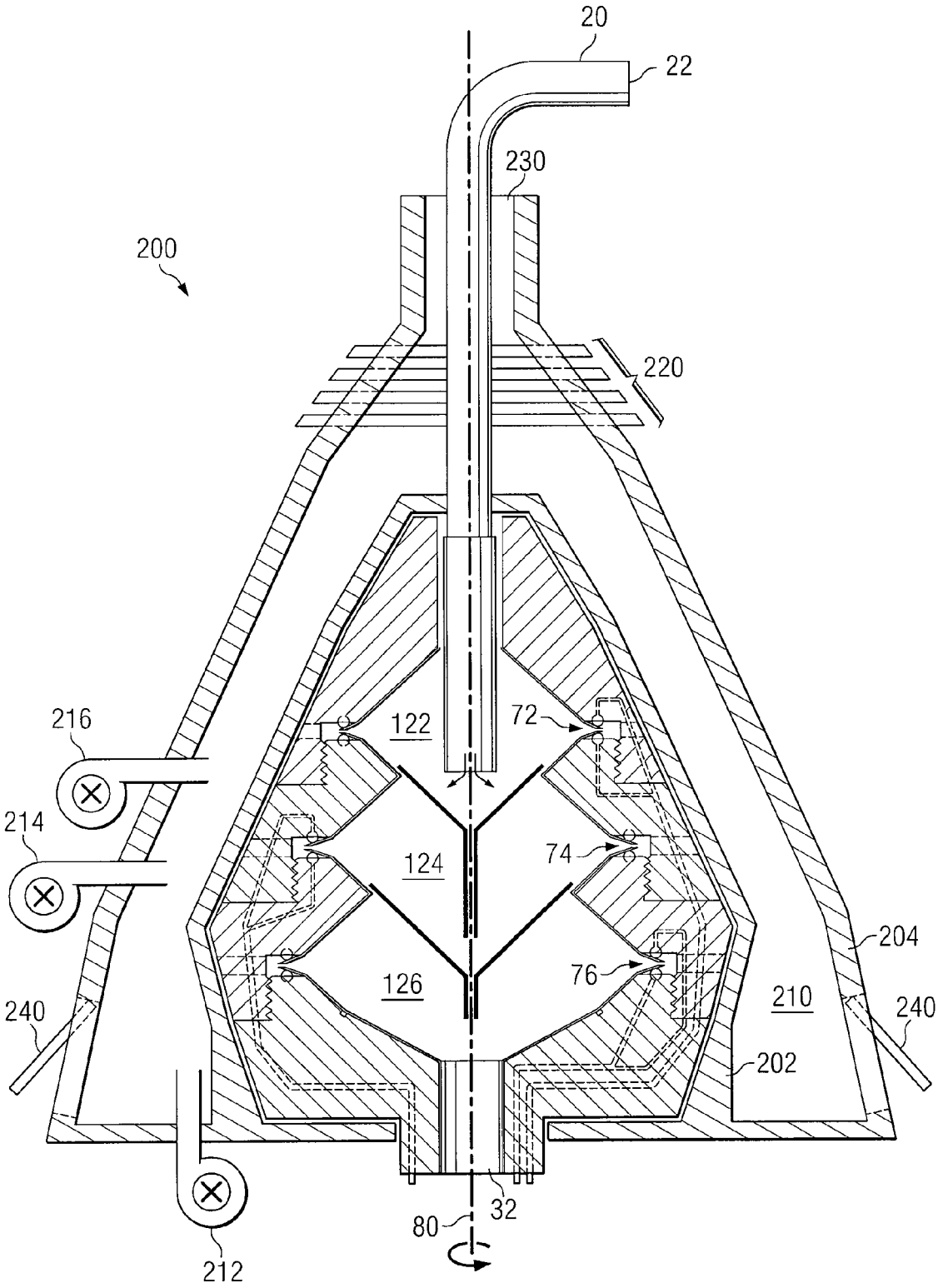
FIG. 8 depicts a cross-section view of an incinerator in accordance with teachings of the present disclosure.

FIG. 8 depicts a cross-section view of one embodiment of incinerator 200 in accordance with teachings of the present disclosure. Incinerator 200 may include multiple ignition sources 212, 214, and 216, a heat exchanger 220, and an exhaust 230, as well as inner wall 202, outer wall 204, and combustion zone 210.

As shown in FIG. 8, classifying centrifuge 10 may include three internal working spaces (122, 124, and 126) with increasing working diameters. Operation of classifying centrifuge 10 may result in separated ejecta delivered into combustion zone 210 at separated points along longitudinal axis 80 (e.g., ejecta ports 72, 74, and 76). A source of ignition may be selectively applied to the separated ejecta in a deliberate sequence chosen to leverage the heat generated by the combustion of the first ejecta to support the combustion of the later ejecta.

In addition, FIG. 8 shows clarified fluid outlet 32 along the base of incinerator 200. In this embodiment, clarified fluid outlet 32 may allow the removal of a clarified fluid after one or more ejecta have been removed from the process fluid.

Ignition sources 212, 214, and 216 may include blowers to introduce air to combustion zone 210, open burners, sparking elements, resistance heaters, and/or any other known devices, components, and/or features used to facilitate combustion, including a combination of such devices. In the embodiment shown, ignition sources 212, 214, and 216 may be independently operable to facilitate selective combustion of ejecta from ejecta outlets 72, 74, and 76.

Heat exchanger 220 may be located anywhere in combustion zone 210 and may be configured to recover heat from combustion zone 210. Heat exchanger 220 may include pipes, vanes, fins, and/or any other device or system operable to transfer heat from combustion zone 210 to another device and/or system. Any recovered heat may be used to generate electricity, provide heat, or supplement any other process or system as needed.

As previously discussed in relation to FIG. 7, combustion of ejecta from internal working space 122, 124, and/or 126 may be more easily initiated. As shown in FIG. 8, combustion of such ejecta may result in flames and/or heat traveling up toward exhaust 230. Those flames and/or heat may interact with ejecta from internal working space 124 and/or internal working space 126, facilitating ignition and/or combustion before reaching exhaust 230. Any combustion may be accelerated or improved by air injectors or similar devices (e.g., 212, 214, and/or 216).

Any unburned material collected at port 240 may have been reduced by the successful incineration of those combustible substances removed by the operation of classifying centrifuge 10. For example, the combustion of contaminants (e.g., volatile organic compounds, flocculants, wash agents, etc.) from the original process fluid may render the remaining material (e.g., the clarified liquid and/or collected solids) more suitable for landfill or alternative disposal means.

FIG. 9 depicts a cross-sectional view of another embodiment of an incinerator incorporating teachings of the present disclosure. In the embodiment shown in FIG. 9, classifying centrifuge 10 has a generally cylindrical outer diameter and multiple internal working spaces (122, 124, and 126) with varying working diameters as discussed in relation to FIG. 1.

Recovery of waste water may become more valuable as the world population grows. At the same time, disposal or incineration of the solids contaminating waste water may require additional resources (e.g., fuel and/or landfill space). Increased efficiency in mechanical de-watering processes may remove more useful water from waste water and reduce the energy required to incinerate the remaining solids. In other cases, increased efficiency in mechanical de-watering processes may reduce the volume of waste that may be stored or disposed.

In some embodiments, de-watered solids ejected from rotating classifying centrifuge 10 may undergo aerosol dispersal from ejecta outlet 70 into non-rotating combustion chamber 210. Aerosol dispersal may expand any ejecta into a mist or suspended fluid and may result in increased flammability. Combustion may result in heat added to combustion chamber 210 which may increase the flammability of any material later ejected from classifying centrifuge 10 into combustion chamber 210.

One example application is disposal of composted waste. In some composting applications, the resulting sludge is not flammable. Although some material may have been digested by bacteria introduced to the compost, heavy metals are not catalyzed. Using teachings of the present disclosure, however, the heavy metals may be classified and combusted as described above.

Although the present invention and its advantages have been described in detail, it should be understood that various changes, substitutions and alternations can be made herein without departing from the spirit and scope of the invention as defined by the following claims.

What is claimed is:

1. A system for removing substances from a process fluid, the system comprising:

a centrifuge body rotatable around a longitudinal axis, the centrifuge body having a first end and a second end;

the first end configured for receiving the process fluid as the process fluid passes through the first end into the centrifuge body;

the second end configured for dispensing a clarified fluid;

a first internal working space inside the centrifuge body having a first working diameter;

a second internal working space inside the centrifuge body having a second working diameter, the second internal working space located between the first working space and the second end;

wherein the second working diameter is greater than the first working diameter;

a first outlet associated with the first internal working space;

a second outlet associated with the second internal working space;

an incinerator coupled with the first and second outlets to receive substances removed from the process fluid by the centrifuge body.

a first valve associated with the first outlet;

a second valve associated with the second outlet;

the first valve and the second valve independently operable to control flow from the respective first working space and the respective second working space;

a pair of lips configured to mate in a closed position blocking flow through the first outlet;

a set of two bladders configured to force the pair of lips into the closed position; and a conduit configured to allow a fluid to inflate the two bladders.

2. A system for removing substances from a process fluid, the system comprising:

a centrifuge body rotatable around a longitudinal axis, the centrifuge body having a first end and a second end;

the first end configured for receiving the process fluid as the process fluid passes through the first end into the centrifuge body;

the second end configured for dispensing a clarified fluid;

a first internal working space inside the centrifuge body having a first working diameter;

a second internal working space inside the centrifuge body having a second working diameter, the second internal working space located between the first working space and the second end;

wherein the second working diameter is greater than the first working diameter;

a first outlet associated with the first internal working space;

a second outlet associated with the second internal working space;

an incinerator coupled with the first and second outlets to receive substances removed from the process fluid by the centrifuge body;

a first annular groove disposed around the longitudinal axis of the centrifuge body and within the first working space;

the first outlet for a first ejecta associated with the first annular groove;

a first liner disposed within the first internal working space, the first liner including a first lip extending into the first annular groove; and a second liner disposed within the first internal working space, the second liner including a second lip extending into the first annular groove;

the first lip and the second lip configured to mate in a closed position retaining a substance within the first annular groove;

a set of two bladders configured to force the pair of lips into the closed position; and a conduit configured to allow a fluid to inflate the two bladders.

3. A system for removing substances from a process fluid, the system comprising:

a centrifuge body rotatable around a longitudinal axis, the centrifuge body having a first end and a second end;

the first end configured for receiving the process fluid as the process fluid passes through the first end into the centrifuge body;

the second end configured for dispensing a clarified fluid;

a first internal working space inside the centrifuge body having a first working diameter;

a second internal working space inside the centrifuge body having a second working diameter, the second internal working space located between the first working space and the second end;

wherein the second working diameter is greater than the first working diameter;

a first outlet associated with the first internal working space;

a second outlet associated with the second internal working space;

an incinerator coupled with the first and second outlets to receive substances removed from the process fluid by the centrifuge body.

a first valve associated with the first outlet;

a second valve associated with the second outlet; and the first valve and the second valve independently operable to control flow from the respective first working space and the respective second working space;

the first valve including:

a first pair of lips configured to mate in a closed position blocking flow through the first outlet;

a first set of two bladders configured to force the first pair of lips into the closed position; and a first conduit configured to allow a fluid to inflate the first set of two bladders; and the second valve including:

a second pair of lips configured to mate in a closed position blocking flow through the second outlet;

a second set of two bladders configured to force the second pair of lips into the closed position; and a second conduit configured to allow a fluid to inflate the second set of two bladders.

* * * * *